US007079805B2

(12) United States Patent
Suzuki

(10) Patent No.: US 7,079,805 B2
(45) Date of Patent: Jul. 18, 2006

(54) SHEET GUIDE DEVICE OF A GUIDE PATH INTERSECTING PORTION AND IMAGE FORMING APPARATUS PROVIDED WITH THE SAME DEVICE

(75) Inventor: Kenji Suzuki, Chiba (JP)

(73) Assignee: Canon Kabushiki Kaisha (JP)

( * ) Notice: Subject to any disclaimer, the term of this patent is extended or adjusted under 35 U.S.C. 154(b) by 184 days.

(21) Appl. No.: 10/414,730

(22) Filed: Apr. 16, 2003

(65) Prior Publication Data

US 2003/0193135 A1 Oct. 16, 2003

(30) Foreign Application Priority Data

Apr. 16, 2002 (JP) ..... 2002-113860

(51) Int. Cl.
*B41J 11/58* (2006.01)

(52) U.S. Cl. ..... 399/401

(58) Field of Classification Search ..... 399/401, 399/374; 400/642; 271/184, 185, 272, 303
See application file for complete search history.

(56) References Cited

U.S. PATENT DOCUMENTS 5,326,092 A * 7/1994 Ando ..... 271/272
5,515,153 A * 5/1996 Tokunoh ..... 399/374
6,286,831 B1 * 9/2001 Marasco et al. ..... 271/303
6,631,249 B1 * 10/2003 Katsumi et al. ..... 399/71
6,741,815 B1 * 5/2004 Fujita et al. ..... 399/45
6,764,236 B1 * 7/2004 Suzuki ..... 400/642
6,782,236 B1 * 8/2004 Sasaki et al. ..... 399/401

FOREIGN PATENT DOCUMENTS

JP 7-149009 6/1995

* cited by examiner

*Primary Examiner*—Hoai Pham
*Assistant Examiner*—Hoa B. Trinh

(74) *Attorney, Agent, or Firm*—Rossi, Kimms & McDowell, LLP

(57) ABSTRACT

A sheet guide device having a first sheet guide path and a second sheet guide path intersecting with each other for guiding a sheet and a pivotally movable guide member pivotally movably provided on a common downstream side corner of the first sheet guide path and the second sheet guide path in an intersecting portion between the first sheet guide path and the second sheet guide path, wherein the pivotally movable guide member is pushed and pivotally moved by the leading edge portion of the sheet passing the intersecting portion to thereby guide the sheet.

9 Claims, 9 Drawing Sheets

SHEET GUIDE DEVICE OF A GUIDE PATH INTERSECTING PORTION AND IMAGE FORMING APPARATUS PROVIDED WITH THE SAME DEVICE

BACKGROUND OF THE INVENTION

1. Field of the Invention

The invention relates to a sheet guide device for guiding a sheet passing along an intersecting sheet guide path, and an image forming apparatus provided with the sheet guide device in the apparatus main body thereof and in which a sheet having an image formed thereon is guided by the sheet guide device.

2. Description of Related Art

In recent years, image forming apparatuses such as a copying machine, a printer, a facsimile apparatus and a compound machine of these have spread, and these image forming apparatuses are of a construction in which the copying machine is the basis. However, owing to the recent rapid spread of personal computers, a construction in which the printer is the basis are becoming the mainstream of the image forming apparatuses. Also, in the image forming apparatuses, two-side printing in which images are formed on the two sides of a sheet has become popular from the viewpoints of environmental countermeasures, the saving of natural resources, etc., and many kinds of machines have become provided with a duplex image forming function.

FIG. 8 of the accompanying drawings is a schematic cross-sectional view of a printer, which is an example of a conventional image forming apparatus taken along a sheet transport direction.

The printer 121 shown in FIG. 8 is such that in an apparatus main body 123, a toner image is transferred to a sheet P fed from a sheet feeding portion 101 in an image forming portion 102, and the sheet is passed through a fixing device 103 to thereby fix the toner image on the sheet. Then, the printer 121 selectively delivers the sheet having had the toner image fixed thereon to a face-down tray (hereinafter referred to as the "FD tray") 106 and a face-up tray (hereinafter referred to as the "FU tray") 105 or transport the sheet to a surface reverse transport path 119, by a combination of a transport path switching gates 111 and 112.

The sheet fed into the surface reverse transport path 119 is switch-back-transported and has its front surface and back surface reversed by the surface reverse transport path 119. The sheet is then transported along a duplex transport path 120 and is again supplied to the image forming portion 102, whereby a toner image is formed on the other side of the sheet. Thus, the toner images have been formed on the two sides of the sheet. The sheet having had the toner images formed on the two sides thereof is finally selectively delivered to the FD tray 106 and the FU tray 105.

FIG. 9 of the accompanying drawings is a schematic cross-sectional view of a printer, which is another example of the conventional image forming apparatus taken along a sheet transport direction.

The printer 122 shown in FIG. 9 is also such that in an apparatus main body 124, a toner image is transferred to a sheet P fed from a sheet feeding portion 101 in an image forming portion 102, and the toner image is fixed by a fixing device 103. The printer 122, when it forms an image only on one side of the sheet, delivers the sheet to the FD tray 106. The printer 122, when it is to form images on the two sides of the sheet, once guides the sheet toward the FD tray 106, and thereafter reverses the rotation of a pair of reverse rollers 116 and reversal-transports the sheet to thereby transport the sheet to a duplex transport path 120. The sheet is transported along the duplex transport path 120, and is again supplied to the image forming portion 102, whereby an image is also formed on the other side of the sheet. Thus, the images have been formed on the two sides of the sheet. The sheet having had the images formed on the two sides thereof is finally delivered to the FD tray.

However, the printers, which are the conventional image forming apparatuses, have caused the following problems.

The printer 121 shown in FIG. 8 has a space and construction exclusively for reversing the sheet going toward the duplex transport path 120 and therefore, the space particularly in the height direction of the apparatus main body 123 of the printer 121 becomes large, and this has led to such problems as the increased cost of a frame construction, etc., the aggravation of operability and a further increase in cost by parts for exclusive use.

The printer 122 shown in FIG. 9 is a mechanism which solves the problems peculiar to the printer 121 shown in FIG. 8, and effects the reversal of the sheet going toward the duplex transport path 120 by a transport path 125 leading toward the FD tray 106. However, the transport path 125 leading toward the duplex transport path 120 is disposed on the left side of the apparatus main body 124 and therefore, there is not a transport path leading toward a tray corresponding to the FU tray 105 shown in FIG. 8 and thus, the FU tray cannot be provided. That is, there has arisen the problem of a reduction in a specification called the curtailment of a delivery port.

SUMMARY OF THE INVENTION

The present invention has as its object to provide a sheet guide device which enables, for example, an image forming apparatus to be compact and be provided with multiple functions without having an exclusive transport path required to form images on the two sides of a sheet and without decreasing the number of sheet delivery ports, and an image forming apparatus provided with the sheet guide device in the apparatus main body thereof.

The present invention provides a sheet guide device having:

a first sheet guide path and a second sheet guide path intersecting with each other for guiding a sheet; and a pivotally movable guide member pivotally movably provided at a common downstream side corner portion of the first sheet guide path and the second sheet guide path at an intersecting portion between the first sheet guide path and the second sheet guide path, wherein the pivotally movable guide member is pushed and pivotally moved by the leading edge portion of the sheet passing through the intersecting portion to thereby guide the sheet.

The present invention provides an image forming apparatus having:

image forming means for forming an image on a sheet;

a first sheet tray for stacking thereon the sheet delivered with the image formed thereon by the image forming means with one side of the sheet facing upwardly;

a second sheet tray for stacking thereon the sheet delivered with the image formed thereon by the image forming means with the other side of the sheet facing upwardly;

a duplex transport path for re-feeding the sheet having had the image formed thereon by the image forming means to the image forming means;

a first sheet transport path leading from the downstream side of the image forming means in a sheet transport direction toward the first sheet tray;

a second sheet transport path branching off from the first sheet transport path on the downstream side of the image forming means in the sheet transport direction, and leading from the image forming means toward the second sheet tray;

a transport switching gate provided in an intersecting portion between the first sheet transport path and the second sheet transport path for switching the sheet transport direction;

a surface reverse transport path leading from the second sheet transport path toward the duplex transport path across the first sheet transport path; and a transport guide gate pivotally movably provided on a common downstream side corner of the first sheet transport path and the surface reverse transport path in an intersecting portion between the first sheet transport path and the surface reverse transport path, wherein the transport guide gate is pushed and pivotally moved by the leading edge portion of the sheet passing through the intersecting portion to thereby guide the sheet.

DETAILED DESCRIPTION OF THE PREFERRED EMBODIMENTS

A sheet guide device according to an embodiment of the present invention and a printer, which is an example of an image forming apparatus, provided with the sheet guide device as a constituent in the apparatus main body thereof will hereinafter be described with reference to the drawings. As the image forming apparatus, there is a printer, a copying machine, a facsimile apparatus or a compound machine of these, and the sheet guide device is adapted to be capable of being incorporated not only as a constituent of the printer, but also as a constituent of the copying machine, the facsimile apparatus or the like.

The sheet guide device is also adapted to be capable of being incorporated as a constituent of a sheet post-treating apparatus for applying at least one post-treating process of bending a sheet, punching the sheet and stapling the sheet.

Further, the sheet guide device is adapted to be capable of being incorporated into the sheet post-treating apparatus of an image forming apparatus having the sheet post-treating apparatus as a constituent thereof as a constituent of the image forming apparatus.

In the description of the name, operation, etc. of the construction, the term "face-up" is herein referred to as "FU" and the term "face-down" is herein referred to as "FD".

(The Whole of the Printer)

Figure 1:
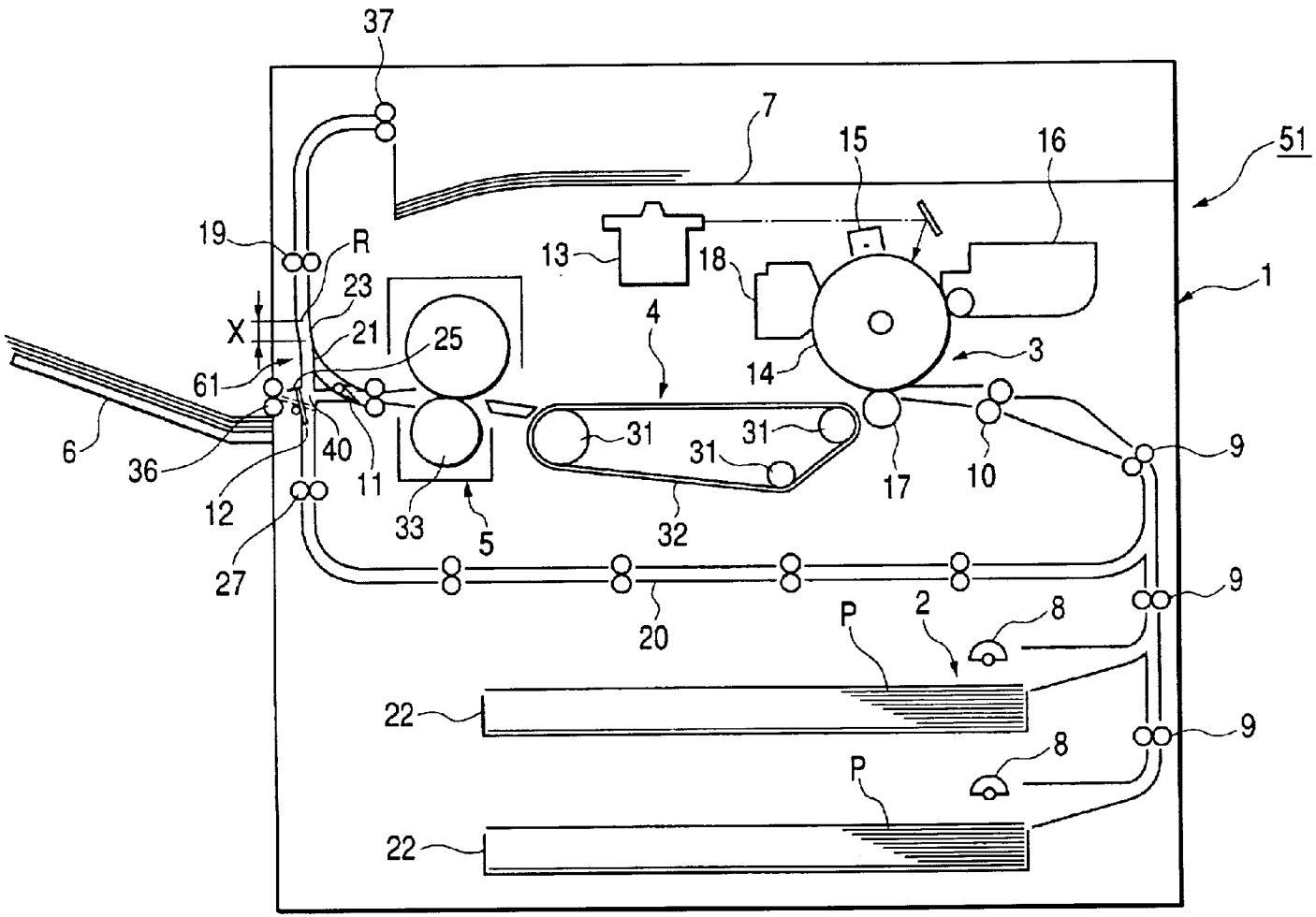
FIG. 1 is a schematic cross-sectional view of a printer provided with an embodiment of the sheet guide device of the present invention in the apparatus main body thereof taken along a sheet transport direction.

FIG. 1 is a schematic cross-sectional view of a printer provided with the sheet guide device in the apparatus main body thereof taken along a sheet transport direction.

The apparatus main body 1 of the printer 51 is provided with a sheet feed portion 2 stacking and containing therein sheets P on which images are to be formed, and feeding them one by one, for example, to an image forming portion 3 as image forming means, the image forming portion 3 for forming a toner image on the sheet, a sheet transport portion 4 for further transporting the sheet to which the toner image has been transferred, a fixing device 5 for substantially permanently fixing the toner image on the transported sheet, a sheet guide device 61 for guiding the sheet having had the toner image fixed thereon to a face-down tray (FD tray) 7 as the second sheet tray of the present invention which will be described later or a face-up tray (FU tray) 6 as the first sheet tray of the present invention, etc.

The sheet is fed out from the sheet feed portion 2, and has a toner image formed thereon by the image forming portion 3, and has the toner image fixed thereon by the fixing device 5. After the fixing, the sheet is delivered to the face-down tray (FD tray) 7 or the face-up tray (FU tray) 6 in the case of one-side printing by a combination of a transport switching gate 11 and a transport guide gate 12.

Also, in the case of two-side printing, the sheet is once transported toward the FD tray 7, and is reversely transported by surface reverse rollers 19 and is transported to a duplex transport path 20. Then, the sheet passes along the duplex transport path 20, and again passes through the image forming portion 3, etc. and has an image also printed on the other side thereof and is delivered to the FD tray or FU tray 6.

(Sheet Feed Portion)

Sheets P contained in a sheet cassette 22 disposed below the apparatus main body 1 are fed out one by one to pairs of transport rollers 9 by a pickup roller 8 in contact therewith being rotated. The sheets P, when fed out from the sheet cassette 22 by the pickup roller 8, are separated one by one by separating means, not shown (such as a separation claw, a separation pad or a reversely rotated roller). Then, the sheet P is transported to a pair of registration rollers 10 provided near the entrance of the image forming portion 3, by the pairs of transport rollers 9.

The pair of registration rollers 10 stop rotating in order to correct the skew feed of the sheet P transported thereto, and time it to the image forming by the image forming portion 3, and receive the leading edge of the sheet and temporarily stop the sheet. The sheet P has its skew feed corrected by the pair of registration rollers 10, and has its timing adjusted to the image forming portion 3 and is transported to the image forming portion 3 by the rotative movement of the pair of registration rollers 10.

(Image Forming Portion)

The image forming portion 3 utilizing an electrophotographic process is comprised of a laser scanner 13 for applying a laser beam on the basis of image data inputted to the printer 51, a photosensitive drum 14 as an image bearing member, a primary charger 15 for uniformly charging the surface of the photosensitive drum 14, a developing device 16 for causing a toner to be attracted to an electrostatic latent image formed on the photosensitive drum 14 to thereby visualize the electrostatic latent image, a transfer roller 17 for transferring the toner image formed on the photosensitive drum 14 to the sheet P, a cleaning apparatus 18 for removing any toner residual on the photosensitive drum 14 for the next image forming operation to thereby clean the photosensitive drum 14, etc. The cleaning apparatus 18 is not always required.

When the image forming operation of the printer 51 is started, the surface of the photosensitive drum 14 is uniformly charged by the primary charger 15. The laser beam of the laser scanner 13 is applied to the charged photosensitive drum 14, whereby image data is written on the photosensitive drum 14. As a result, an electrostatic latent image is formed on the photosensitive drum 14. The developing device 16 causes the toner to be attracted to the photosensitive drum 14 on which the electrostatic latent image has been formed, whereby a toner image to be transferred to the sheet is formed on the surface of the photosensitive drum 14.

The toner image formed on the photosensitive drum 14 is transferred to the sheet P transported from the pair of registration rollers 10 so as to be synchronized with the above-described image forming operation, by the transfer roller 17. Any extra toner or the like residual on the surface of the photosensitive drum 14 is removed by the cleaning apparatus 18. As a result, the photosensitive drum 14 assumes a clean state in preparation for the next image forming operation.

(Sheet Transport Portion)

The sheet P to which the toner image has been transferred by the transfer roller 17 of the image forming portion 3 is further transported in the downstream direction by a sheet transport portion 4 provided downstream of the photosensitive drum 14 in the sheet transport direction. The sheet transport portion 4 has a transport belt 32 passed over transport rollers 31. The transport belt 32 carries thereon the sheet P to which the toner image has been transferred and transports it to the fixing device 5 on the downstream side.

(Fixing Device)

The fixing device 5 nips the sheet P to which the toner image has been transferred between a pair of fixing rollers 33 heated by a heater (not shown) and applies heat and pressure to the sheet to thereby fuse the toner and substantially permanently fix the toner image on the surface of the sheet.

(Face-down Delivery (FD Delivery) of the Sheet)

Description will now be made of the operation of the FD delivery of the sheet. The sheet P passed between the pair of fixing rollers 33 of the fixing device 5 has its transport direction upwardly switched by a transport switching gate 11 being in a position indicated by solid line in FIG. 1, and passes along the introduction path 23*a* (see FIG. 2) of a face-down transport path (FD transport path) 23, facing, for example, in a vertical direction as a second sheet delivery path, and pushes a return preventing piece 21 aside and is guided to the delivery path 23*b* of the FD transport path 23. Then, the sheet is delivered, for example, from a pair of face-down delivery rollers (a pair of FD transport rollers) 37 as a second delivery port to the FD tray 7 with the surface of the sheet on which the toner image has been formed facing down.

Figure 2:
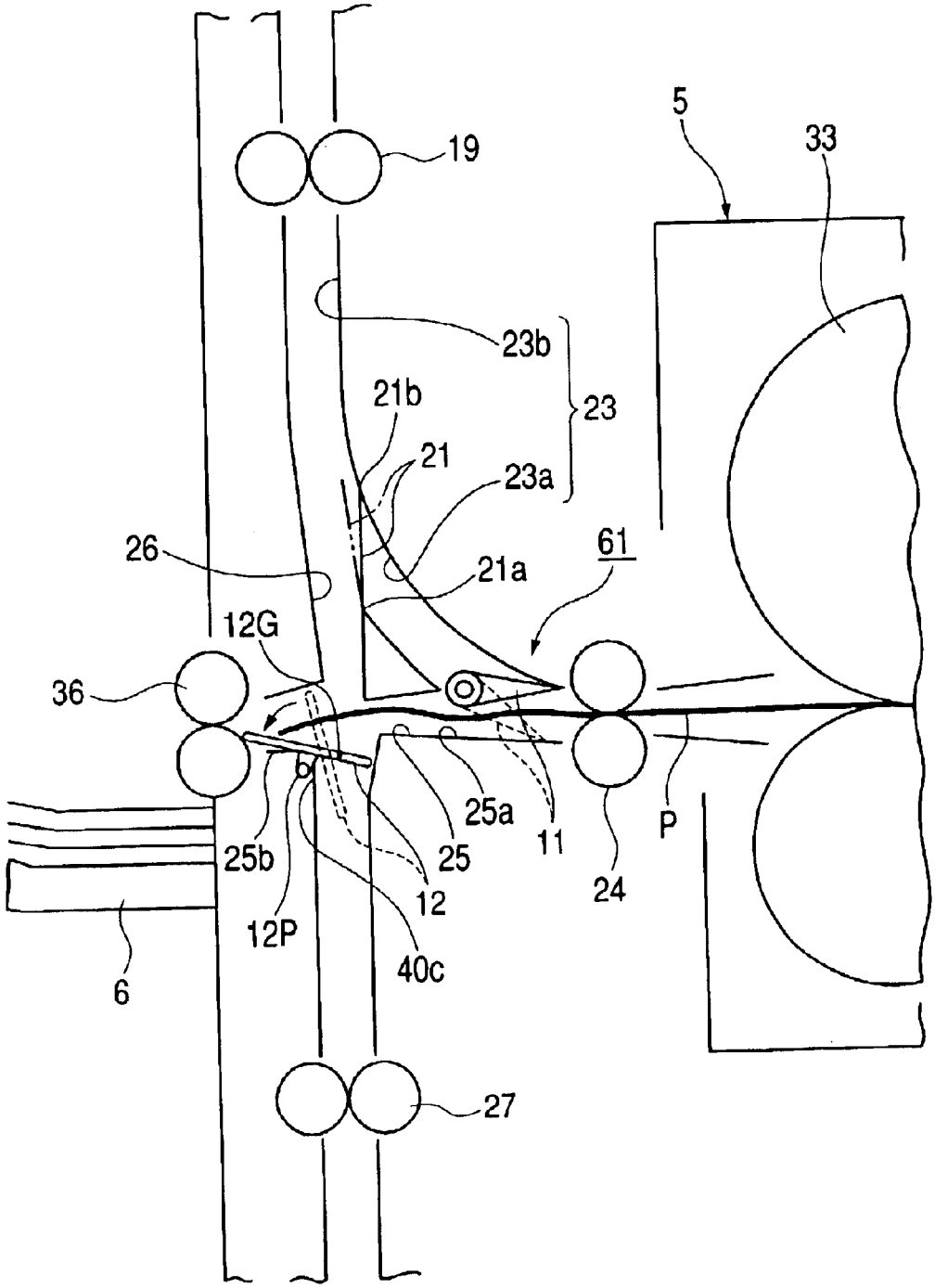
FIG. 2 is a schematic cross-sectional view of an embodiment of the sheet guide device of the present invention taken along the sheet transport direction, and showing a state in which a sheet passing along a face-up transport path is guided.

The return preventing piece 21 shown in FIG. 2 is a sheet-shaped or plate-shaped elastic member, and has its lower end 21*a* fixed to the exit of the introduction path 23*a* and has its distal end 21*b* adapted to be capable of being flexed as indicated by broken line. Accordingly, the return preventing piece 21 normally closes the exit of the introduction path 23*a*, and is pushed by the sheet going from the introduction path 23*a* toward the delivery path 23*b*, and is flexed as indicated by broken line to thereby permit the passage of the sheet, but is adapted to block the entry of the sheet from the delivery path 23*b* into the introduction path 23*a*.

(Face-up Delivery (FU Delivery) of the Sheet)

Description will now be made of the operation of the FU delivery of the sheet. The sheet P passed between the pair of fixing rollers 33 of the fixing device 5 is transported to a pair of transport rollers 24, and is transported rectilinearly along the introduction path 25*a*, for example, of a face-up transport path (FU transport path) 25 as a first sheet delivery path by the transport switching gate 11 being in apposition indicated by solid line in FIG. 2.

Further, the sheet P is transported along the delivery path 25*b* of the FU transport path 25 by a transport guide gate 12 being in a position indicated by solid line in FIG. 2 which will be described later, and is delivered, for example, from a pair of face-up delivery rollers (a pair of FU delivery rollers) 36 as a first delivery port to the FU tray 6 with its surface on which the toner image has been formed facing upwardly. When the transport guide gate 12 is in a position indicated by broken line in FIG. 2, the sheet P pushes down the transport guide gate 12 to the position indicated by solid line and is moved to the pair of FU delivery rollers 36.

(During Duplex Transport)

Description will now be made of the operation of again transporting a sheet to the image forming portion when a toner image is also to be formed on the other side of the sheet having had a toner image transferred to one side thereof. The sheet P having passed between the pair of fixing rollers 33 of the fixing device 5 has its transport direction upwardly switched by the transport switching gate 11 being in a position indicated by broken line in FIG. 2, and pushes the return preventing piece 21 aside and is transported toward the FD tray 7.

Figure 3:
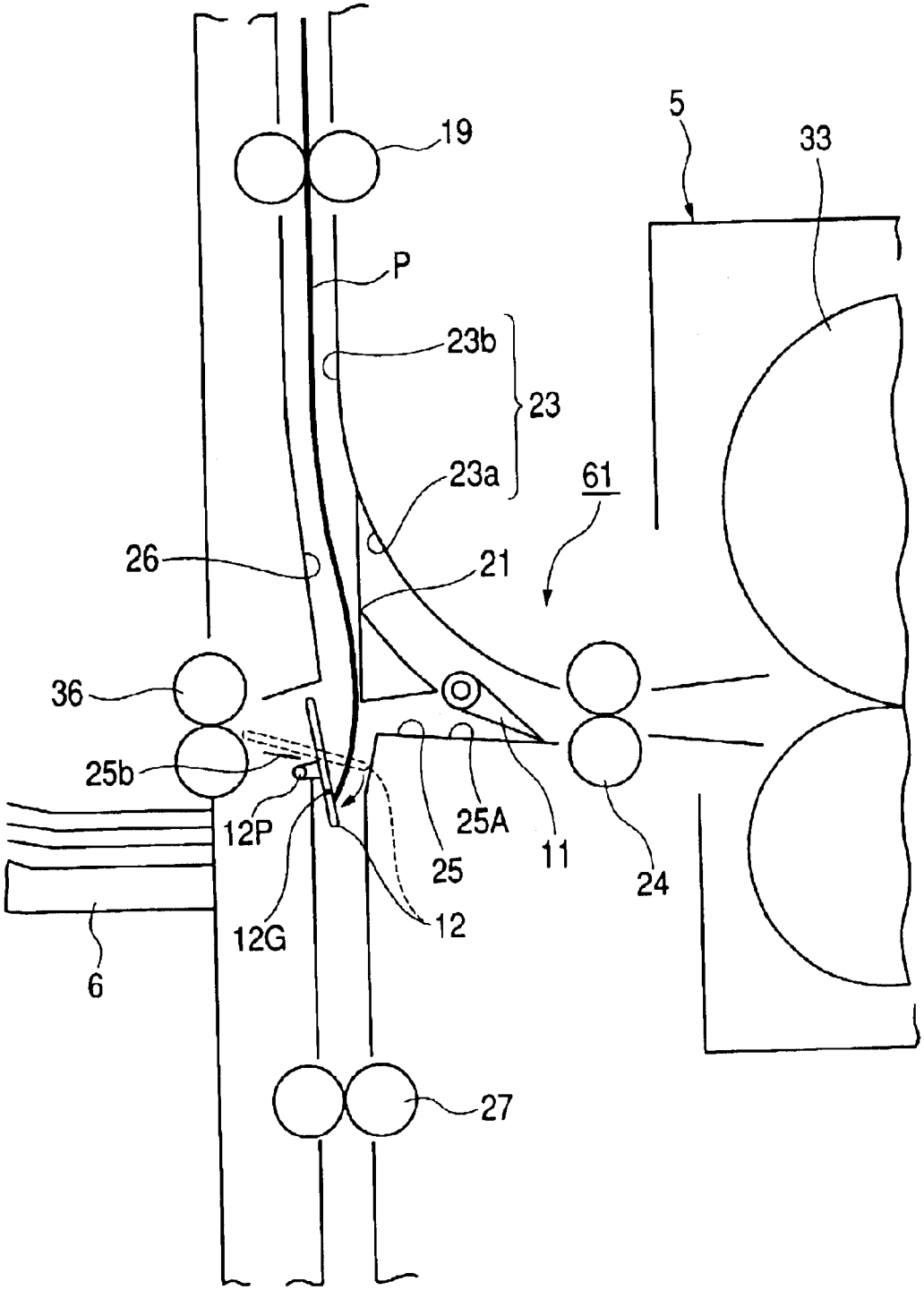
FIG. 3 is a schematic cross-sectional view of the embodiment of the sheet guide device of the present invention taken along the sheet transport direction, and showing a state in which the sheet passing along a surface reverse transport path is guided.

Then, the trailing edge of the sheet P passes the return preventing piece 21 and the sheet P is transported to a position R (surface reverse point) advanced by a distance X indicated in FIG. 1 from the return preventing piece 21, whereupon the sheet P is downwardly transported and guided by the reverse rotation of a pair of surface reverse rollers 19 and the guide by the transport guide gate 12 being in a position indicated by solid line in FIGS. 1 and 3, and is moved along a surface reverse transport path 26 facing in a vertical direction. When the transport guide gate 12 is in a position indicated by broken line in FIG. 3, the sheet pushes down the transport guide gate 12 to the position of broken line and is transported.

The sheet P is further transported by a pair of transport rollers 27, and is directed, for example, to a duplex transport path 20 as re-feeding means. Thereafter, the sheet P joins a transport path from the sheet cassette 22, and is delivered to the FD tray 7 or FU tray 6 via a process similar to that for the first side.

(Sheet Guide Device)

The sheet guide device 61 will hereinafter be described. First, the sheet guide device 61 uses the delivery path 23*b* of a portion of the FD transport path 23 and a surface reverse transport path 26 for the operation of reversing the front surface and the back surface of the sheet P going toward the duplex transport path 20. The sheet guide device 61 is of a construction in which the,FU transport path 25 leading to the FU tray 6 and the surface reverse transport path 26 intersect with each other and therefore, the compatibility of the space saving of the printer 51 and the existence of the FU tray 6.

However, if the FU transport path 25 and the surface reverse transport path 26 are made to simply intersect with each other, faulty transport such as the hitching of the sheet will occur in an intersecting portion 40, as will be described below. An effect peculiar to the present invention will be described here in contrast with a sheet guide device in which there is not mounted the transport guide gate 12 which is the characteristic construction of the present invention.

Figure 4:
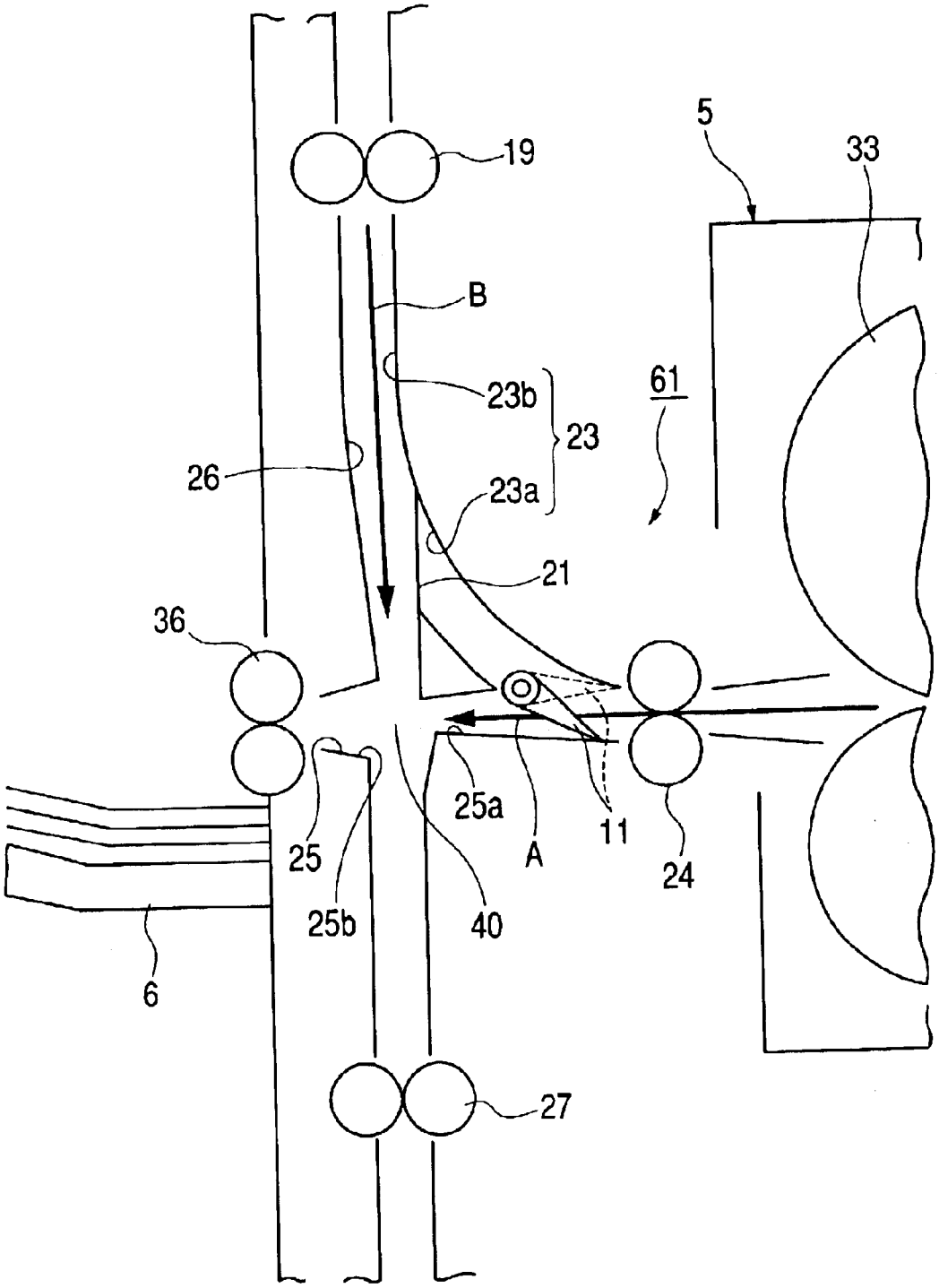
FIG. 4 is a view for illustrating the guide direction of the sheet passing the intersecting portion of the sheet guide device.

As shown in FIG. 4, there are two directions, i.e., a direction indicated by the arrow A and a direction indicated by the arrow B in which the sheet P comes into the intersecting portion 40 between the FU transport path 25 and the surface reverse transport path 26. When as in the present embodiment, the intersecting portion 40 is located near the fixing device 5, depending on the kind of the sheet, the sheet may be greatly curled (flexed).

Figure 5:
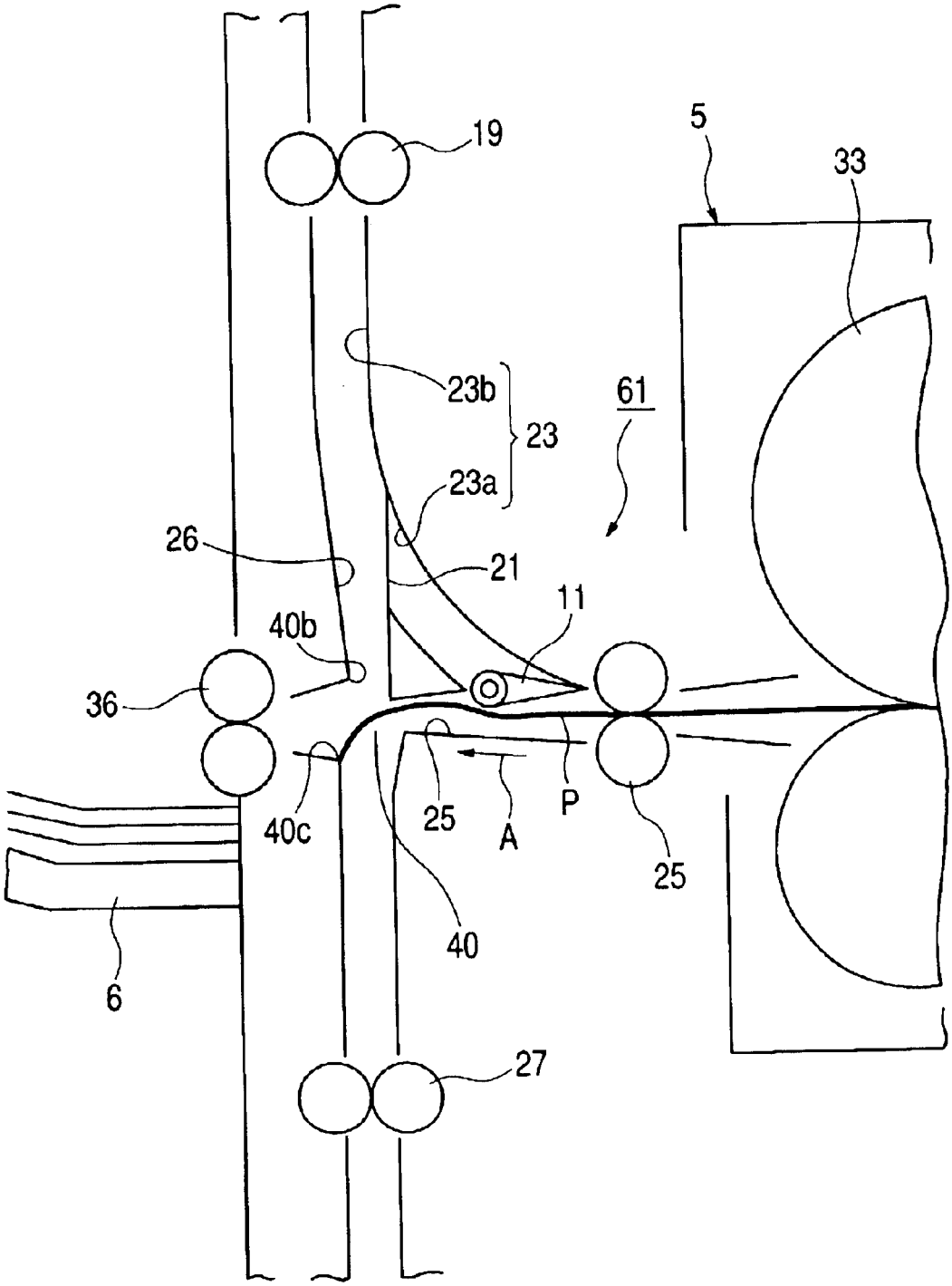
FIG. 5 shows a state in which in the sheet guide device of FIG. 4, the sheet passing through the intersecting portion hitches on to the downstream side corner of the face-up transport path.

Therefore, as shown in FIG. 5, the sheet P passing the intersecting portion 40 from the direction indicated by the arrow A may hitch on to one of the downstream side corner 40*b* and corner 40*c* of the four corners of the intersecting portion 40. On the other hand, as shown in FIG. 6, the sheet P passing the intersecting portion 40 from the direction of arrow B may hitch on to one of the downstream side corner 40*c* and corner 40*d* of the four corners of the intersecting portion 40.

Figure 7:
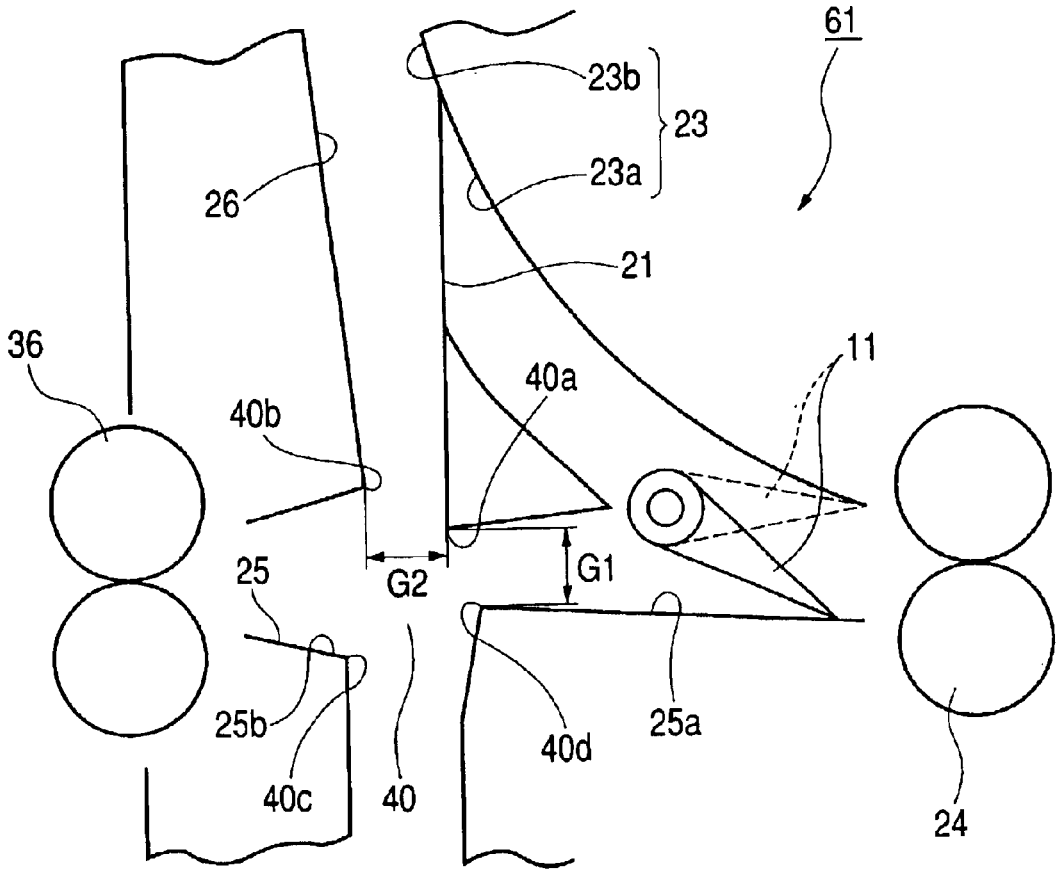
FIG. 7 is a view for illustrating the gaps among the four corners of the intersecting portion.
Figure 8:
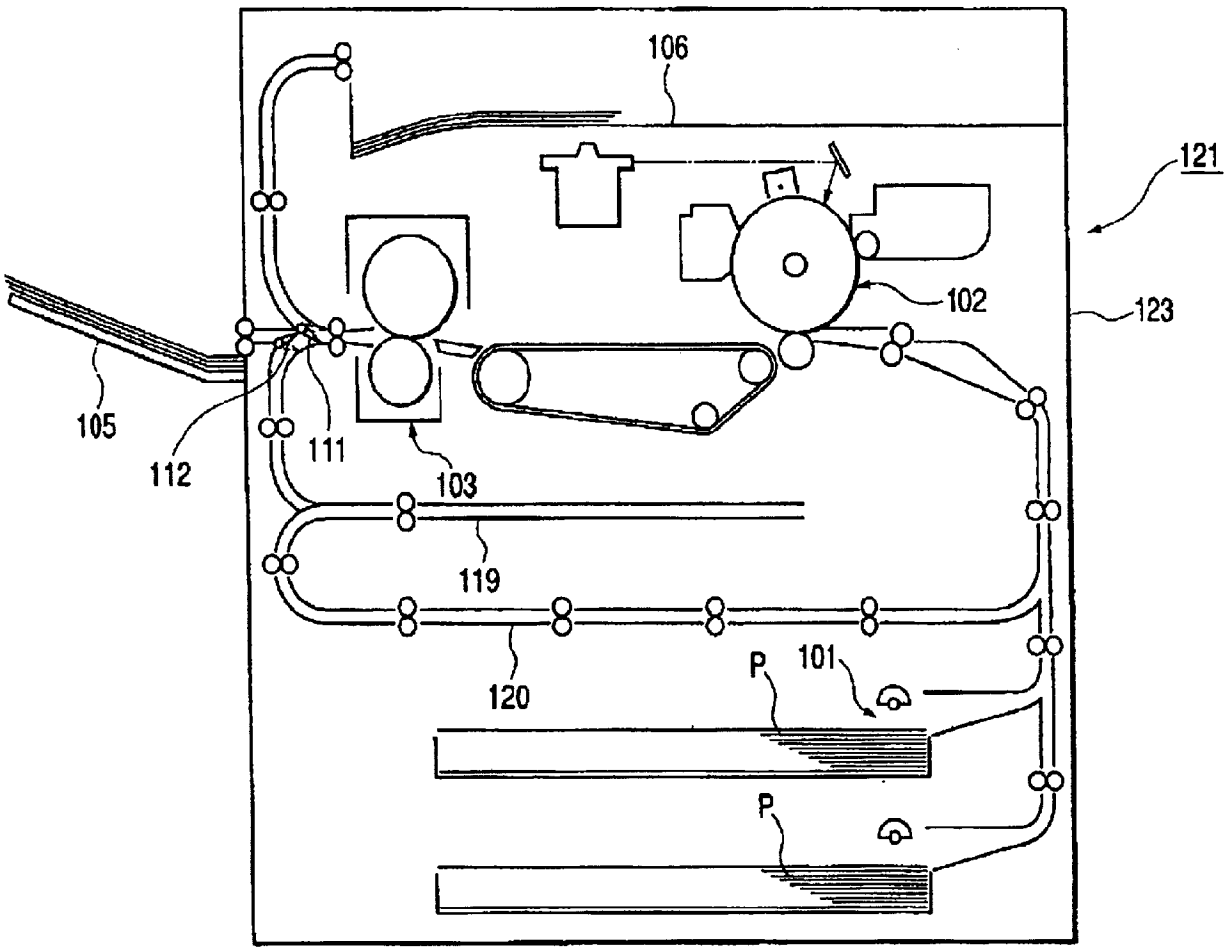
FIG. 8 (PRIOR ART)
FIG. 8 is a schematic cross-sectional view of an example of a conventional printer taken along a sheet transport direction.
Figure 9:
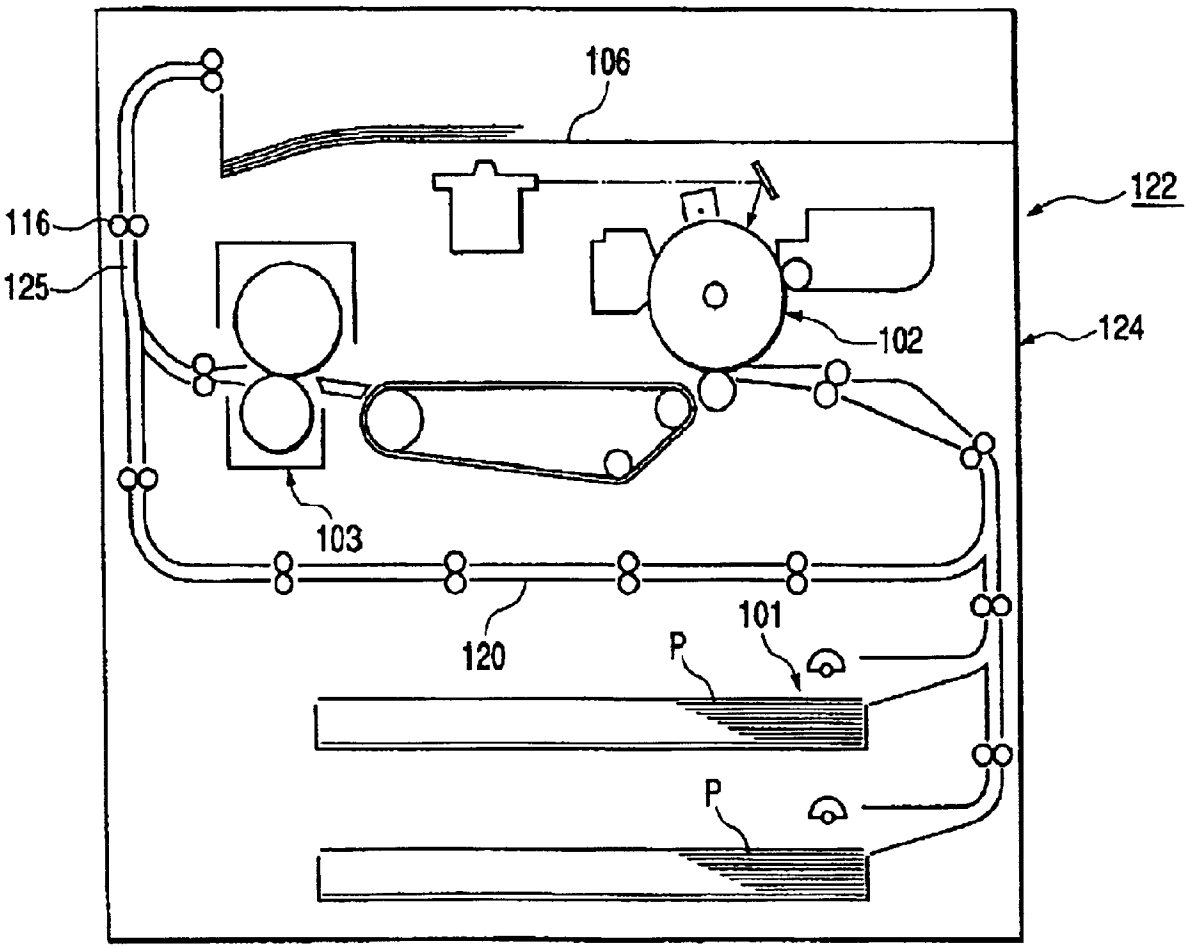
FIG. 9 (PRIOR ART)
FIG. 9 is a schematic cross-sectional view of another example of the conventional printer taken along a sheet transport direction.

The hitching on to the corner 40*b* and the corner 40*d* can be avoided by the contrivance of the shape and disposition including the level difference of the corner 40*a* relative to the corners 40*b* and 40*d*. That is, as shown in FIG. 7 wherein the transport guide gate 12 is omitted, the sheet guide device 61 is of a construction in which the gap G1 between the corner 40*a* and the corner 40*d* and the gap G2 between the corner 40*a* and the corner 40*b* are made narrower by about 30% to about 70% than an ordinary guide gap and a sufficient level difference is provided between the corner 40*a* and the corner 40*b* and between the corner 40*a* and the corner 40*d*, to thereby regulate the transport position of the sheet P and avoid the hitching on the corner 40*b* and the corner 40*d*.

Figure 6:
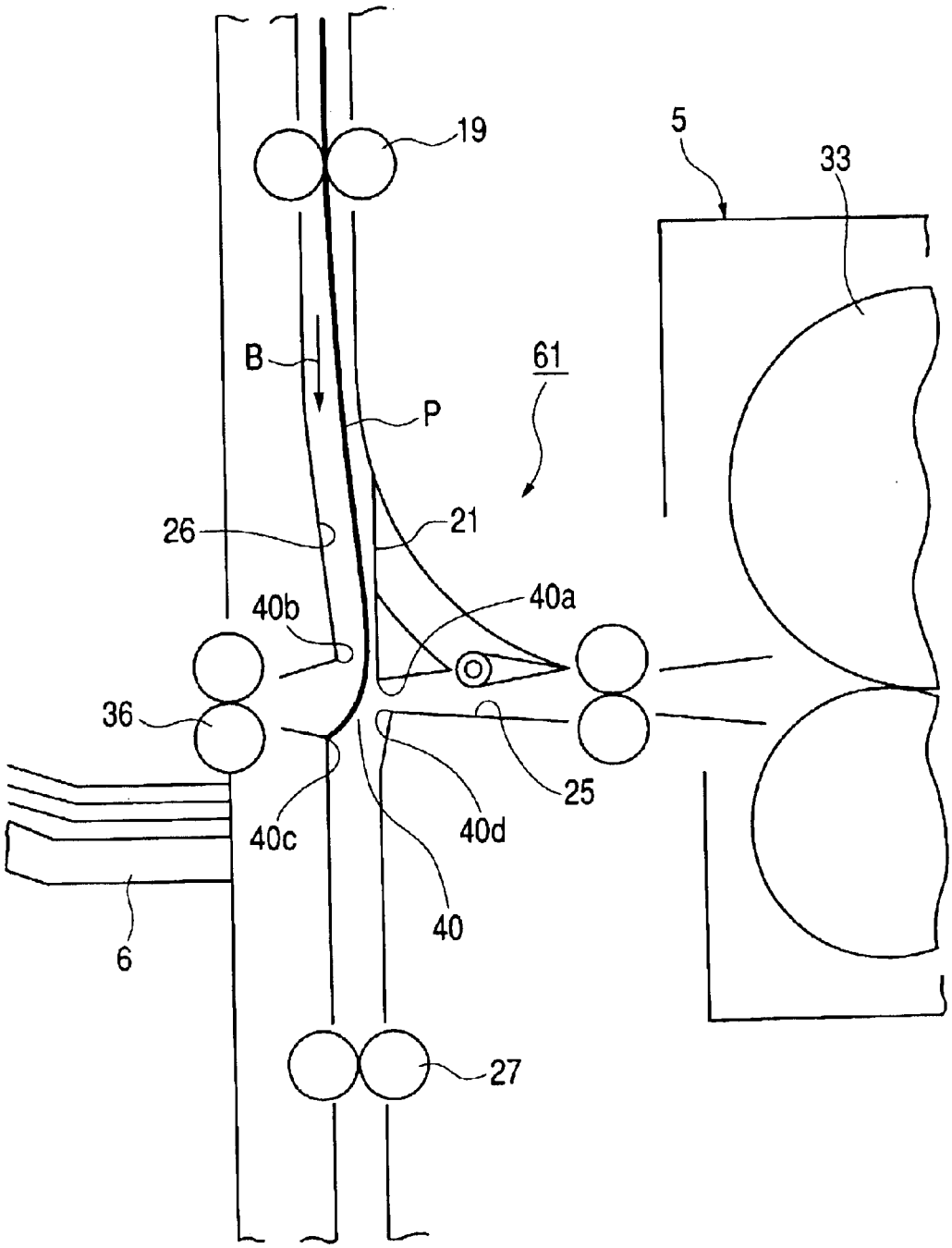
FIG. 6 shows a state in which in the sheet guide device of FIG. 4, the sheet passing intersecting portion hitches on to the downstream side corner of the surface reverse transport path.

However, the hitching of the sheet, for example, on to the corner 40*c* as a downstream side corner common to the FU transport path 25 and the surface reverse transport path 26 is from two directions, i.e., the direction indicated by the arrow A and the direction of arrow B indicated in FIG. 4, and in some cases, as shown in FIGS. 5 and 6, there is the possibility that the hitching is not avoided. Moreover, the fixing device 5 imparts heat to the image surface side (toner surface side) of the sheet and therefore, when the sheet is particularly plain paper or thin paper (when the basic weight of the sheet is about 90 g/m$^2$), the sheet is curled as shown in FIG. 6 and the image surface side thereof protrudes and is liable to hitch on to the downstream side corner 40*c*.

So, the sheet guide device 61 according to the present embodiment is of a construction in which the transport guide gate 12 is disposed at the downstream side corner 40*c*. That is, the sheet guide device 61 is provided with the FU transport path 25 as the first sheet guide path (first sheet transport path) of the present invention and the surface reverse transport path 26 as the second sheet guide path (second sheet transport path) of the present invention which intersect with each other and guide the sheet, and the transport guide gate 12 as a pivotally movable guide member provided for pivotal movement in the transport direction of the sheet on the common downstream side corner 40*c* of the FU transport path 25 and the surface reverse transport path 26 in the intersecting portion 40 wherein the FU transport path 25 and the surface reverse transport path 26 intersect with each other, and the transport guide gate 12 is adapted to be pushed by the leading edge portion of the sheet passing the intersecting portion 40 and be pivotally moved to thereby guide the leading edge portion of the sheet.

Therefore, the sheet guide device 61 can avoid the hitching of the sheet on to the downstream side corner 40*c*, and can prevent the jam of the sheet by a simple construction. Also, as shown in FIGS. 2 and 3, even a sheet P having its leading edge curled can be reliably and smoothly guided downstream by the guide of the transport guide gate 12.

Further, the transport guide gate 12, when pushed and pivotally moved by the leading edge portion of the sheet, prevents the sheet from entering the surface reverse transport path 26 from the FU transport path 25 along which the sheet has been transported, or entering the FU transport path 25 from the surface reverse transport path 26.

Therefore, it never happens in the sheet guide device 61 that the sheet enters from other transport path from a transport path along which it is moving, and the sheet can be reliably guided along a predetermined transport path.

Further, the pivotal movement center shaft 12P of the transport guide gate 12 is provided in the area of the downstream side corner 40*c*. Therefore, the sheet guide device 61 enables the construction of the transport guide gate 12 to be simplified, and the operating range of the transport guide gate 12 may be small. Consequently, the space saving of the printer 51 becomes possible.

Also, the centroid 12G of the transport guide gate 12 is disposed on the right side of the pivotal movement center shaft 12P in FIG. 2 and therefore, the transport guide gate 12 is always biased in a clockwise direction as viewed in the figure, and is so located as to close the FU transport path during a non-operation. The sheet guide device 61 is designed such that the transport guide gate 12 can be pushed by the stiffness of the sheet and be readily rotated, whereby it can be switched and thus, it is not necessary to provide the transport guide gate 12 with driving means such as a motor or a plunger for rotating the transport guide gate 12, and the structure of the sheet guide device 61 can be simplified and the cost thereof can be reduced.

In this manner, the printer (image forming apparatus) 51 according to the present embodiment causes the sheet to be guided by the sheet guide device 61 for reliably guiding the sheet in such a manner that by the transport guide gate 12 provided in the intersecting portion between the FU transport path 25 for delivering and guiding the sheet and the surface reverse transport path 26 for reversing the sheet by the utilization of the FD transport path 23, the hitching of the sheet in the intersecting portion is prevented and the sheet does not enter other transport path from a transport path along which the sheet is moving.

Therefore, the printer 51 can be compact and can have multiple functions without having any exclusive transport path necessary to form images on the two sides of the sheet and without decreasing the number of the sheet delivery ports. Also, the compatibility of space saving and the existence of the FU tray becomes possible.

Further, the transport guide gate 12 of the printer 51 is disposed so as to guide the non-image surface side of the sheet. Therefore, even immediately after the sheet has passed through the fixing device 5, the printer 51 does not cause a defective image such as image rubbing or a streaked image on the image forming surface, and can form an image of high quality on the sheet.

While in the present embodiment, the transport guide gate 12 is formed into a plate-like shape, the present invention is not restricted thereto, but the transport guide gate 12 may assume any shape in which a portion thereof for guiding the sheet is a flat surface, and further, while the centroid of the transport guide gate 12 is disposed on the right side of the pivotal movement center shaft 12P in FIG. 12, it may be disposed on the left side of the pivotal movement center shaft 12P. That is, the transport guide gate 12 can be biased toward one of the introduction path 25*a* and the surface reverse transport path 26 so that the surface thereof for guiding the sheet may be substantially parallel to the introduction path 25*a* or the surface reverse transport path 26 without fail when it does not guide the sheet.

Also, the sheet guide device of the present invention can be applied not only to the delivery portion in the present embodiment, but to any portion, which is, an intersecting transport path.

What is claimed is:

1. A sheet guide device comprising:

a first sheet guide path and a second sheet guide path intersecting with each other for guiding a sheet; and a pivotally movable guide member freely pivotally provided on a common downstream side corner of said first sheet guide path and said second sheet guide path in an intersecting portion between said first sheet guide path and said second sheet guide path, wherein leading edge of the sheet passing said intersecting portion pivotally moves said pivotally movable guide member, wherein a sheet passing through said first sheet guide path moves said pivotally movable guide while pushing one end side portion of said pivotally movable guide member so that said pivotally movable guide member guides the sheet through said first sheet guide path, and wherein a sheet passing through said second guide path moves said pivotally movable guide while pushing another end side portion of said pivotally movable guide member so that said pivotally movable guide member guides the sheet through said second sheet guide path.

2. A sheet guide device according to claim 1, wherein said pivotally movable guide member, when pushed and pivotally moved by the leading edge of the sheet transported by said first sheet guide path, blocks entry of the sheet being transported from said first sheet guide path into said second sheet guide path.

3. A sheet guide device according to claim 1, wherein said pivotally movable guide member has its center of pivotal movement provided on said downstream side corner.

4. An image forming apparatus comprising:

image forming means for forming an image on a sheet;

a first sheet tray for stacking thereon the sheet delivered with the image formed thereon by said image forming means with one side of the sheet facing upwardly;

a second sheet tray for stacking thereon the sheet delivered with the image formed thereon by said image forming means with the other side of the sheet facing upwardly;

a duplex transport path for re-feeding the sheet having had the image formed thereon by said image forming means to said image forming means;

a first sheet transport path leading from a downstream side of said image forming means in a sheet transport direction toward said first sheet tray;

a second sheet transport path branching off from said first sheet transport path on the downstream side of said image forming means in the sheet transport direction, and leading from said image forming means toward said second sheet tray;

a transport switching gate provided in a branching-off portion of said second sheet transport path from said first sheet transport path for switching the transport direction of the sheet;

a surface reverse transport path leading from said second sheet transport path toward said duplex transport path across said first sheet transport path; and a transport guide gate freely pivotally provided on a common downstream side corner of said first sheet transport path and said surface reverse transport path in an intersecting portion between said first sheet transport path and said surface reverse transport path, wherein a leading edge of the sheet passing said intersecting portio pivotally moves said pivotally movable guide member, wherein a sheet passing through said first sheet guide path moves said pivotally movable guide while pushing one end side portion of said pivotally movable guide member so that said pivotally movable guide member guides the sheet through said first sheet guide path, and wherein a sheet passing through said second guide path moves said pivotally movable guide while pushing another end side portion of said pivotally movable guide member so that said pivotally movable guide member guides the sheet through said second sheet guide path.

5. An image forming apparatus according to claim 4, wherein said transport guide gate, when pushed and pivotally moved by the leading edge of the sheet transported by said first sheet transport path, blocks entry of the sheet being transported from said first sheet transport path into said surface reverse transport path.

6. An image forming apparatus according to claim 4, wherein said transport guide gate has its center of pivotal movement provided on said downstream side corner.

7. An image forming apparatus according to claim 4, wherein the sheet transported to said second sheet transport path is reversely tarsnported to said surface reverse transport path to thereby reverse surfaces of the sheet and transport the sheet to said duplex transport path.

8. An image forming apparatus according to claim 7, wherein a return preventing member is provided between said second sheet transport path and said surface reverse transport path so that the sheet may not return to said second sheet transport path when the sheet is reversely transported so that the surfaces of the sheet is reversed.

9. An image forming apparatus according to claim 4, wherein said transport guide gate is disposed at a position for guiding a side opposite to a side of the sheet on which the image has been formed by said image forming means.

* * * * *